United States Patent [19]

Houseman

[11] 4,440,616

[45] Apr. 3, 1984

[54] METAL COLLECTOR

[75] Inventor: Kenneth R. Houseman, Westlake, Ohio

[73] Assignee: General Dental Inc., St. Louis, Mo.

[21] Appl. No.: 431,026

[22] Filed: Sep. 30, 1982

[51] Int. Cl.[3] ..... C25C 7/00; C25B 11/12

[52] U.S. Cl. ..... 204/272; 204/273; 204/275; 204/294

[58] Field of Search ..... 204/272, 273, 275, 291, 204/294, 290 R, 109

[56] References Cited

U.S. PATENT DOCUMENTS

| | | | |
|---|---|---|---|
| 3,694,341 | 9/1972 | Luck, Jr. | 204/272 X |
| 3,953,313 | 4/1976 | Levenson | 204/294 X |
| 3,959,110 | 5/1976 | Burgess | 204/275 X |
| 4,028,212 | 6/1977 | Bowen et al. | 204/272 |
| 4,269,690 | 5/1981 | Graham | 204/272 |
| 4,302,318 | 11/1981 | Mock | 204/272 X |
| 4,372,829 | 2/1983 | Cox | 204/275 X |

*Primary Examiner*—Donald R. Valentine

*Attorney, Agent, or Firm*—Pearne, Gordon, Sessions, McCoy, Granger & Tilberry

[57] ABSTRACT

A device for collecting ionized metal from a liquid solution, such as silver from photographic or radiographic solutions, which is highly efficient in operation and convenient in use. Efficiency of the device results from a unique impeller/turbulator which, besides being adapted to pump liquid through the device, induces a relatively high state of turbulence in such flow that promotes electrolytic action. A cathode on which metal ions are deposited is formed of a flexible sheet of carbon-filled plastic that is low enough in cost to be conveniently disposable.

8 Claims, 7 Drawing Figures

METAL COLLECTOR

BACKGROUND OF THE INVENTION

The invention relates to electrolytic separation of metals from solutions, and in particular relates to improvements in apparatus for performing such separation.

PRIOR ART

Electrolytic recovery of silver from photographic or radiographic film processing solutions and other metallic ionized elements from different solutions such as plating solutions is known. A generally known class of device for recovering silver from processing solutions employs a cylindrical chamber through which processing fluid is conducted for electrolytic treatment. A cathode formed by or disposed adjacent and essentially coextensive with the cylindrical wall of the chamber receives silver from the processing solution by electrolytic action. An anode is disposed at or adjacent the axis of the cylinder. Processing solution is circulated through the chamber while electric current is established between the electrodes through the solution.

In prior art devices, circumferential currents of solution typically are induced by stationary nozzles such as shown in U.S. Pat. Nos. 4,028,212 to Bowen et al. and 4,149,954 to Ransbottem, for example, or rotating impellers such as shown in U.S. Pat. No. 3,694,341 to Luck, Jr. As shown in the mentioned U.S. Pat. No. 4,028,212, for instance, a cathode has been formed of flexible stainless steel sheet stock rolled into a cylinder and unrolled or otherwise flexed to separate it from an accumulation of deposited silver. It is also known from U.S. Pat. No. 3,953,313 to Levenson and from my U.S. Pat. No. 4,175,026, for example, to employ carbon filaments or carbon coatings in the construction of cathodes.

SUMMARY OF THE INVENTION

The invention provides an improved device for collecting metallic material from solutions with increased efficiency of operation and greater convenience to the user. In accordance with one aspect of the invention, there is provided a novel impeller/turbulator unit which, besides serving a primary function of pumping solution through the collector chamber, serves the important function of inducing turbulent flow of solution in the collector chamber. This turbulent flow of solution greatly improves the efficiency of the electrolysis action. As disclosed, the collector chamber is cylindrical in form and the impeller/turbulator comprises a rotor disc that is driven in rotation about the axis of the chamber. The disc includes a plurality of radially extending channels which establish centrifugal flow in the solution. The channels of the impeller/turbulator include passages that induce a high degree of turbulence by developing local axial currents which are in counterflow relation to a main axial flow of solution to the collector chamber. An additional effect contributing to turbulent flow in the collector chamber is the action of the impeller/turbulator that angularly sweeps obliquely directed currents through stationary, radial paths of inflow currents.

Another aspect of the invention involves a disposable cathode element formed of carbon-filled plastic sheet material. As disclosed, the cathode is provided as a rectangular sheet that is dimensioned to be curled into a single layer liner on the inner wall of a hollow, cylindrical housing forming the collector chamber. The flexible but resilient character of the cathode sheet permits it to be readily positioned in the collector chamber of the housing with minimal effort, skill, and time, and therefore with a high degree of convenience. The construction of the cathode sheet, moreover, in terms of the cost of raw sheet stock and the fabrication of individual finished sheets, is of such low value as to make it practical to treat the cathode as disposable after one period of use. Disposal of the cathode sheet frees the operator/user of the collector device from the task of cleaning it of collected material and simplifies the steps required of the operator to recharge the unit with a clean cathode. Removal of the cathode sheet from the collected or recovered material electrolytically deposited thereon can be performed at a location remote from the point of use of the collector device. In fact, the cleaning step can be altogether eliminated where the collected metal is smelted, since the cathode sheet will simply burn off the collected metal. Segregating or eliminating the process of stripping the cathode of material collected on it can lead to a reduction in loss or waste of collected material, which can be quite important where this material is silver or other precious metal.

DESCRIPTION OF THE PREFERRED EMBODIMENT

Figure 1:
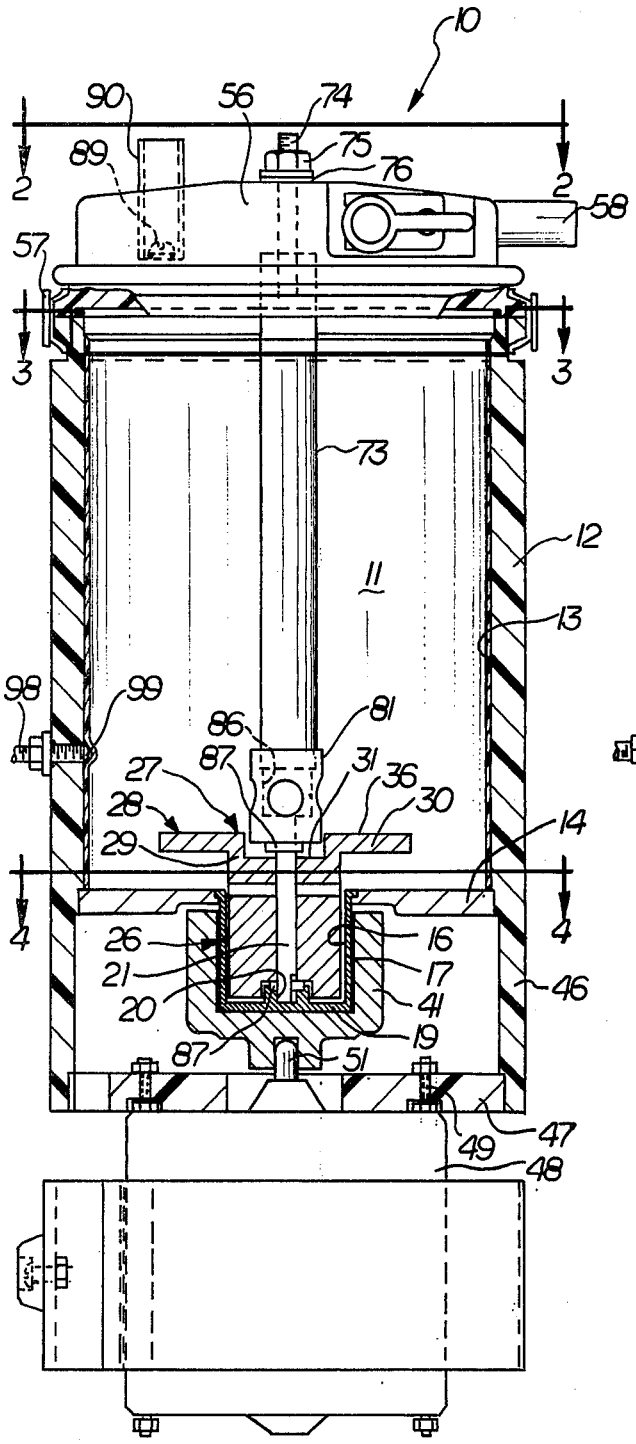
FIG. 1 is a longitudinal, cross-sectional view of a metal collector device constructed in accordance with the invention.
Figure 2:
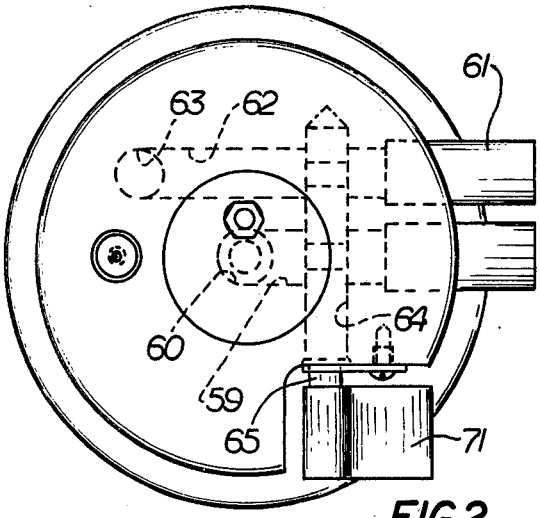
FIG. 2 is a front end view of the collector device, taken at the lines 2—2 in FIG. 1.
Figure 3:
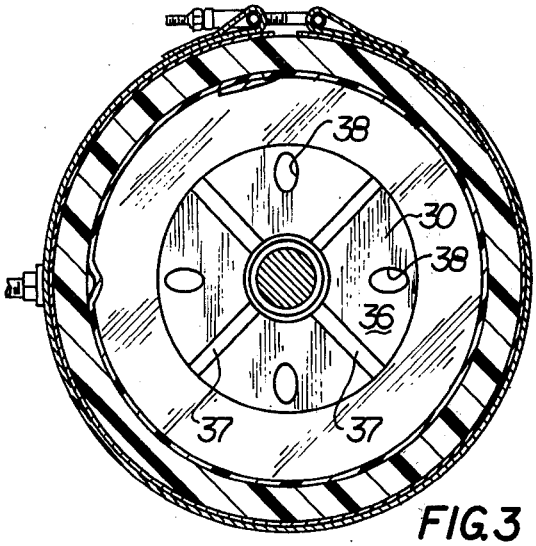
FIG. 3 is a transverse, cross-sectional view of the collector device, taken on the lines 3—3 in FIG. 1.
Figure 4:
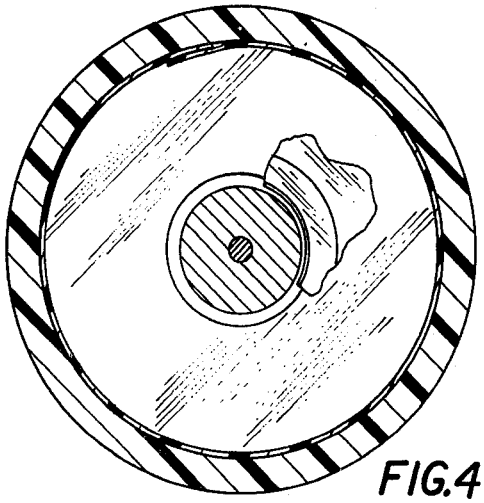
FIG. 4 is a transverse, cross-sectional view of the collector device, taken along the lines 4—4 in FIG. 1.

There is shown a device 10 for collecting silver or other ionized metals in photographic, radiographic, or like liquid solutions. The device 10 includes a liquidtight collector chamber or cell 11 disposed within a hollow, cylindrical housing 12. An interior, cylindrical surface 13 of the housing 12 forms the circumferential boundary of the collector chamber 11. By way of example, the illustrated chamber 11 has a nominal length of approximately 7.25 inches and a diameter of approximately 5.7 inches. At its inner end, the chamber 11 is bounded by a transverse wall 14 permanently sealed to interior surfaces of the housing 12. A cylindrical pocket 16 concentric with the axis of the housing 12 is open to the collector chamber 11. The pocket 16 is provided by a cup 17 sealed at the edges of its mouth to a counterbored aperture 18 in the end wall 14. At the center of a base 19 of the cup 17, a blind bore 20 provides a seat for a spindle shaft 21.

Figure 6:
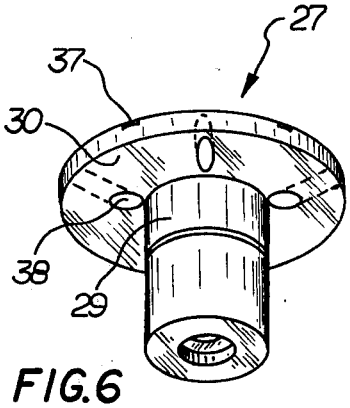
FIG. 6 is a perspective view of an impeller/turbulator element of the invention.

Partially disposed in the pocket 16 is a hub assembly 26 of an impeller/turbulator 27. A rotor 28 of the impeller/turbulator 27 (FIG. 6) has a center hub section 29 and an annular disc section 30 axially and radially outward of this hub section. The plane of the hub 29 is offset from the disc 30 to provide a central recess 31. The plane of the disc 30 extends transversely to the chamber axis, and is spaced with a gap from the chamber end wall 14. An outer face 36 of the impeller/turbulator rotor disc 30 has a plurality of angularly spaced, open-faced slot channels 37 extending radially between its inner and outer diameter. At angular locations intervening the open channels 37, there are formed in the rotor disc 30 closed boundary channels 38 extending both radially and axially with respect to the chamber axis. These latter channels 38 have inlet openings on the inner side of the disc 30 adjacent the hub 29 and outlet openings on the outer face of the disc remote from the hub 29. In the disclosed arrangement, the closed boundary channels 38 are cylindrical and have their individual axes lying in a common imaginary cone forming an oblique angle with the plane of the rotor disc 30. The impeller/turbulator hub 29 is permanently attached by gluing or other suitable means to the remainder of the hub assembly 26, which is assembled in the cup pocket 16. The hub assembly 26 is permanently magnetized so that it is magnetically coupled with a cup-shaped driver 41, also permanently magnetized, and telescoped over the housing pocket cup 17.

A skirt section 46 of the housing 12 extending axially beyond the collector chamber 11 receives and supports an end wall 47. An electric motor 48 is mounted on the end wall 47 by screws 49. An output shaft 51 of the motor 48 projecting into the space of the skirt 46 is received in an inner end of the magnetic driver 41 and supports the driver in rotation about the axis of the chamber 11.

The outer end of the housing chamber 11 is closed by a removable end plate or cover 56. The end plate 56 is generally circular in form, having a diameter substantially equal to the outside diameter of the housing 12. The end plate cover 56 is releasably retained on the housing 12 by a clamp ring 57 of known construction and operation, which seats in circumferential grooves in the housing and cover.

An inlet hose coupling 58 extending radially with respect to the end closure 56, a radial passage 59 in the closure, and a central axial passage 60 in the body of the closure are serially interconnected to form an inlet flow path for solution into the chamber 11. Similarly, a hose coupling 61, a transverse passage 62, and an axial passage 63 are serially interconnected to form an outlet for solution from the chamber 11. Journaled in a cross bore 64 intercepting the inlet and outlet passages 60,62 is a cock 65 having double ports individually aligned with these passages. An external handle 71 is manually pivoted from the illustrated open position, where the cock ports are aligned with the passages 60,62 through 90 degrees to a closed position where the ports are perpendicular to these passages. The axial outlet passage 63 opens directly into the outer end of the chamber 11 near its wall 13, while the inlet passage 60 is coupled with a central anode tube 73. The anode tube 73, preferably of stainless steel or other noncorrosive, electrically conductive material, is retained on the closure plate 56 by a threaded stem 74 of like material welded or otherwise secured to it. The threaded stem 74 extends through a suitable bore in the closure plate 56 and is retained by a threaded nut 75. A gasket 76 prevents leakage along the stem bore. Inlet flow of liquid entering through the coupling 58 is axially conducted by the anode 73 centrally through substantially the full length of the chamber 11. A hollow, cylindrical cap 81, pressed or otherwise retained on the inner or free end of the anode 73, has a plurality of outlets 82 in the form of radially extending, cylindrical holes 83. A lower end face of the nozzle or cap 81 is provided with a small central bore 86 for journaling an outer end of the spindle shaft 21. Thrust washers 87 are provided adjacent opposite ends of the spindle shaft, and are adapted to bear against opposed ends of the rotor and hub assembly units 28,26.

A screw 89 of stainless steel or other noncorrosive material in a threaded bore through the end closure plate 56 and an associated hose coupling 90 provide a bleed port for releasing air from the chamber 11 to initially charge it with liquid solution. The housing 12, end wall 14, cup 17, end closure 56, nozzle 81, and couplings 58,61,90 are formed of suitable corrosion-resistant, plastic material such as polyvinyl chloride.

In accordance with the invention, there is disposed in the chamber 11 a cathode sheet 96 which forms a replaceable liner for the cylindrical chamber wall 13. The cathode sheet 96, ideally, is a flexible, originally flat sheet of polyvinyl chloride filled with carbon. The carbon is uniformly dispersed through the body of the sheet, and is sufficiently high in content to render the sheet 96 electrically conductive and place it in a class of materials known as directly platable plastics. For example, the sheet can have a relatively low bulk resistivity of approximately 7 ohms. The sheet typically can have a thickness of 0.0625 inch, for example.

Figure 5:
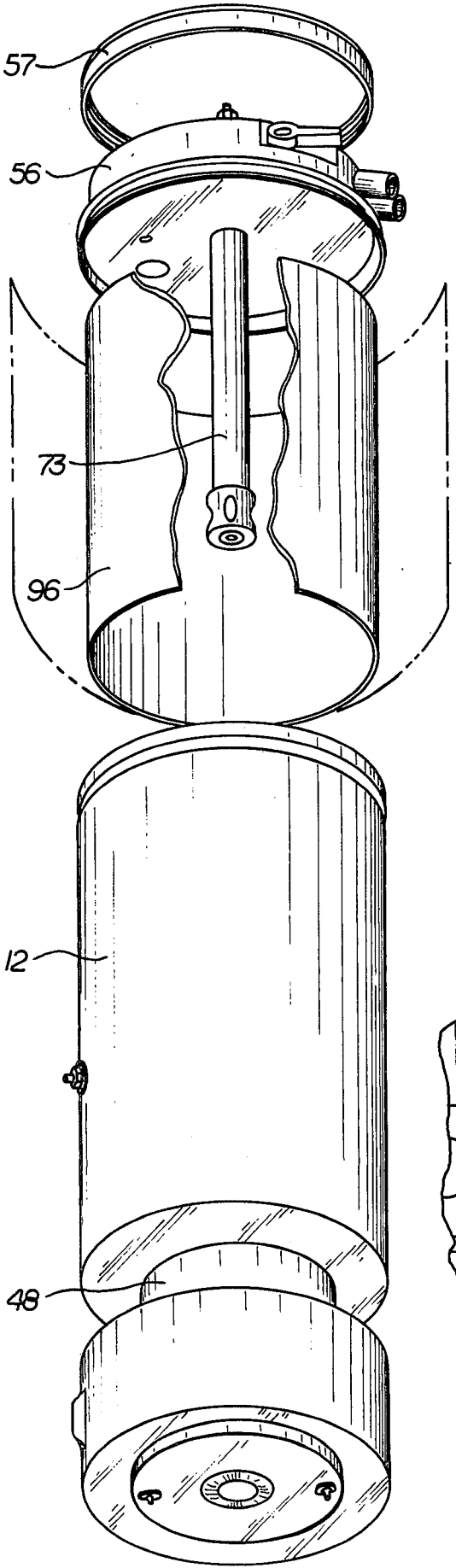
FIG. 5 is a perspective view of the collector device, with certain parts in exploded relation to illustrate details of its assembly.

As suggested in FIG. 5, the originally flat, imperforate cathode sheet 96 is flexed into a cylinder and, with the end closure 56 removed, is inserted into the chamber 11. The transverse dimensions, i.e., the length and width of the cathode sheet 96, generally correspond to the circumference and axial length of the interior surface 13 so that when the cathode sheet is inserted in the chamber 11, it forms a single layer through substantially the full length of the chamber 11. The natural resiliency of the polyvinyl chloride forming the cathode 96 is operative to expand it into a snug fit against the chamber wall 13. A threaded stud 98 of stainless steel or other electrically conductive, corrosion-resistant material is threaded into a threaded hole through the side of the housing 12. An end 99 of the stud 98 projects into the chamber to assure that it is in direct electrical contact with the cathode sheet 96.

In operation of the device 10 to collect ionized metal from a liquid solution, a storage tank, process tank, system piping, or other like reservoir of such solution is suitably connected to the inlet and outlet hose couplings 58, 61. With the cock 65 open and motor 48 operating, the collector device 10 is self-pumping by virtue of the action of the impeller/turbulator 27. It will be understood that during operation of the device, a suitable electrical power supply is connected across the anode and cathode terminals formed by the threaded stem 74 and threaded stud 98.

Net flow through the collector chamber 11 involves central axial flow of incoming liquid through the anode 73 and tangential outflow through the axial passage 63. This net flow is induced through the chamber 11 by operation of the impeller/turbulator 27. More particularly, fluid in the immediate vicinity of the rotor 28 is continuously driven by centrifugal force from the central areas of the rotor disc 30 to the outer peripheral areas of the disc. Radial flow from the nozzle holes 82 is primarily induced by the open-faced channels 37 in the rotor disc 30. The radial flow draws fluid from the nozzle holes 82 and forces it outwardly towards the wall 13 of the chamber 11. Rotation of the disc 30 also causes the liquid solution to swirl in the same direction. It is presently believed, from the foregoing analysis, that flow currents can be considered to be generally helical along the chamber wall 13 axially outward from the impeller/turbulator 27 to the outlet 63 in the closure plate 56.

Figure 7:
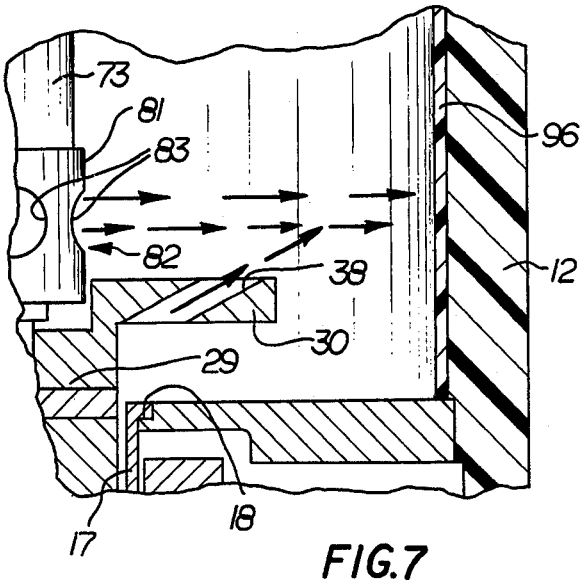
FIG. 7 is a diagrammatic illustration of the currents induced by the impeller/turbulator.

An important feature of the impeller/turbulator 27 is its ability to generate a high turbulence and eddies which greatly increase the deposition rate of metal ions on the cathode 96. The turbulence and eddies are believed to be the result of the action of the oblique closed boundary rotor channels 38, which draws in liquid on the inner face of the disc 30 at its generally central regions and expels currents on the outer periphery of its outer face. Inspection of FIG. 7 reveals that the axes of the closed boundary rotor passages 38 intersect the plane of the axes of the radial nozzle holes 82. Thus, the currents of liquid expelled from the rotary disc passages or channels 38 sweep through the stationarily located streams issuing from the nozzle holes 82. This sweeping action is believed to induce a pulsation of the currents in the chamber 11, which results in excessively high levels of turbulence that advantageously improve the deposition rate of ionized metal on the cathode 96.

When a sufficiently heavy coating of metal has been deposited on the cathode 96, the end closure 56 is disassembled from the housing 12 and the cathode 96 and metal deposit on it are removed from the chamber 11. A new sheet of cathode material is positioned in the chamber 11 and the collection process can be resumed.

The disclosed cathode material is relatively inexpensive and can be considered to be disposable. When used as a disposable element, the cathode sheet makes use of the device 10 highly convenient for the operator. There is no need, for example, for the operator to strip the cathode and collected metal apart. The cathode and collected metal can be shipped to a metal smelter for full credit without the possibility of loss of material which could occur where an operator attempted to scrape or otherwise clean the metal from the cathode. The smelting operation simply burns off the cathode, thereby eliminating the need for labor in cleaning the cathode.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A device for collecting ionized metal from a liquid solution comprising a generally cylindrical chamber, means forming a cathode for receiving metal deposits adjacent the circumference of the chamber, an anode in the chamber adjacent its axis, a liquid inlet and means associated with the inlet for supplying liquid to a zone adjacent the axis of the chamber and adjacent one end thereof, outlet means adjacent an opposite end of the chamber for conducting liquid from the chamber, an impeller/turbulator supported in the chamber between said inlet means and said chamber one end for rotation about the axis of said chamber, means to rotate said impeller/turbulator about the chamber axis, the impeller/turbulator having a rotor including flow inducing channel means having an axial component in its orientation, said impeller/turbulator being adapted to induce a turbulent helical pattern of flow of liquid through the chamber, said channel means having said axial component having a closed boundary, said impeller/turbulator including a disc concentrically disposed on the axis of the chamber, said channel means having an inlet on a side of the disc facing said one chamber end and an outlet on a side of the disc facing said opposite chamber end.

2. A device as set forth in claim 1, wherein said inlet means includes a nozzle for admitting liquid into the chamber along a path generally radially oriented with respect to said chamber axis, said impeller/turbulator channel means inducing current which intersects the path of liquid discharged from said inlet nozzle.

3. A device for collecting ionized metal as defined in claim 1, wherein said cell is cylindrical and said cathode comprises an originally flat sheet, said sheet being sufficiently flexible to be rolled into a cylinder, inserted into said cell, and released to spring into substantially full contact with the wall of said cell.

4. A device for collecting ionized metal as set forth in claim 3, wherein said sheet cathode is carbon filled polyvinyl chloride.

5. A device for collecting ionized metal as set forth in claim 3, wherein said sheet cathode has a bulk resistivity in the order of 7 ohms.

6. A device for collecting ionized metal as set forth in claim 5, wherein said sheet cathode is imperforate.

7. A device for collecting ionized metal as set forth in claim 6, wherein said sheet cathode has a thickness of approximately 0.0625 inch.

8. Apparatus for collecting ionized metal from a liquid solution comprising a fluidtight housing including a cylindrical chamber, a removable end wall closing one end of the chamber, a flexible cathode sheet of carbon-filled plastic material lining the interior cylindrical wall of the chamber, the sheet being insertable and removable through said one chamber end with removal of the end wall, an anode in the chamber extending generally along its axis, terminal means associated with each of the cathode and anode for establishing electrical current therebetween through the liquid in the chamber, an inlet for admitting fluid into the chamber including a nozzle for producing a plurality of angularly spaced, radially directed currents of liquid in a plane parallel to and adjacent an associated end wall of the chamber, an impeller/turbulator supported in the chamber between the inlet nozzle and the associated chamber end wall for rotation about the axis of the chamber, means for rotating the impeller/turbulator about the chamber axis, the impeller/turbulator including a plurality of angularly spaced centrifugal flow inducing channels, said channels including portions having an axial component of orientation whereby currents passing therethrough sweep through the inlet nozzle currents and create a high degree of turbulence, and an outlet for discharging fluid from the chamber at an end thereof opposite said associated end.

* * * * *